US005458205A

United States Patent [19]

Wijk

[11] Patent Number: 5,458,205

[45] Date of Patent: Oct. 17, 1995

[54] LIQUID DRIVEN HAMMER MACHINE

[75] Inventor: Gunnar Wijk, Enskede, Sweden

[73] Assignee: Atlas Copco Rocktech AB, Nacka, Sweden

[21] Appl. No.: 145,346

[22] Filed: Oct. 29, 1993

[30] Foreign Application Priority Data

Nov. 11, 1992 [SE] Sweden ..... 9203365

[51] Int. Cl.[6] ..... E21C 1/12

[52] U.S. Cl. ..... 173/105; 173/206; 173/DIG. 3

[58] Field of Search ..... 173/DIG. 3, DIG. 4, 173/206, 107, 105

[56] References Cited

U.S. PATENT DOCUMENTS

| | | | |
|---|---|---|---|
| 2,108,989 | 2/1938 | Mack | 173/107 |
| 3,307,638 | 3/1967 | Kurt | 173/105 |
| 4,034,817 | 7/1977 | Okada | 173/DIG. 4 X |
| 4,157,121 | 6/1979 | Amtsberg et al. | 173/DIG. 4 X |
| 4,282,937 | 8/1981 | Hibbard | 173/DIG. 4 X |
| 4,349,075 | 9/1982 | Henriksson | 173/DIG. 4 X |

*Primary Examiner*—Rinaldi I. Rada
*Attorney, Agent, or Firm*—Mark P. Stone

[57] ABSTRACT

Liquid driven hammer machine with a machine housing (1) and a hammer piston (2) moveable to-and-fro in guides (4,5) in the machine housing. The guides are made with an intermediate section (6) and end sections (7,8) on either sides thereof. The slot between the intermediate section and the hammer piston is less than, preferably one half of, the slot between the end section and the hammer piston at the end of the end section turned away from the intermediate section. The intermediate section has according to an advantageous embodiment an ax/al extension which is approximately one third of the length of the guide.

12 Claims, 2 Drawing Sheets

LIQUID DRIVEN HAMMER MACHINE

BACKGROUND OF THE INVENTION

The present invention relates to a liquid driven hammer machine, more particularly the invention relates to a guide for the hammer piston included in the hammer machine.

In previously known hammer machines, which are provided with cylindrical guides for the to-and-fro movement of the hammer piston, the problem occasionally arises that the lubrication in the guide is insufficient, which causes the hammer piston to seize with damages on hammer piston and guide as result. The cause of this problem is that the hammer piston is not centered in the guide but comes into metallic contact with the guide.

SUMMARY OF THE INVENTION

The present invention, which is defined in the subsequent claims, aims at eliminating the above mentioned problem by providing the hammer device with at least one guide which is designed such that a centering force is applied to the hammer piston if the hammer piston deviates from its centered position in the housing in which a space or slot defined between the hammer piston and the guide is equal at all positions along the direction of axial or longitudinal extension of the guide. This is achieved by providing the guide with an intermediate section and two end sections, one on each side of the intermediate section, whereby the slot or space defined between the intermediate section and the hammer piston is narrower than the slot between the end sections and the hammer piston. Deviation of the hammer piston from its centered position in the guide decreases the slot or space defined between one side of the hammer piston and the guide, resulting in an increased liquid pressure applied to the side of the hammer piston deviating toward the guide. This increased pressure causes a side force which strives to bring the hammer piston back to a central position in the guide.

It has turned out to be advantageous if the guide is designed such that the intermediate section thereof extends a distance in an axial or longitudinal direction that is less than one half of the distance that the entire guide extends in the longitudinal or axial direction. It is particularly advantageous if the intermediate section extends a distance in the axial direction which is approximately one third the distance that the entire guide extends in the axial direction. It is also advantageous to define the slot or space between the hammer piston and the intermediate section of the guide to be less than three-fourths, and preferably about equal to one-half, of the slot or space defined between the hammer piston and the ends of the end sections of the guide which are located furthest away from the intermediate section of the guide (i.e., the ends of the end sections remote from the intermediate section of the guide). To facilitate production or manufacture of the guide, it is advantageous to form the intermediate section and the end sections as cylindrical sections so that a step is defined at the positions at which the two end sections of the guide join the intermediate section of the guide. It is also possible to form the end sections as conical sections or as a number of cylindrical sections for providing a plurality of steps.

BRIEF DESCRIPTION OF THE DRAWINGS

In order to obtain a large centering force the intermediate section should be given a short axial extension in order to give a large pressure rise when liquid is drawn into the slot between the intermediate section and the hammer piston. At the same time the axial extension of the intermediate section must not be too short because that leads to increased leakage which counteracts the pressure rise.

An embodiment of the invention

Figure 1:
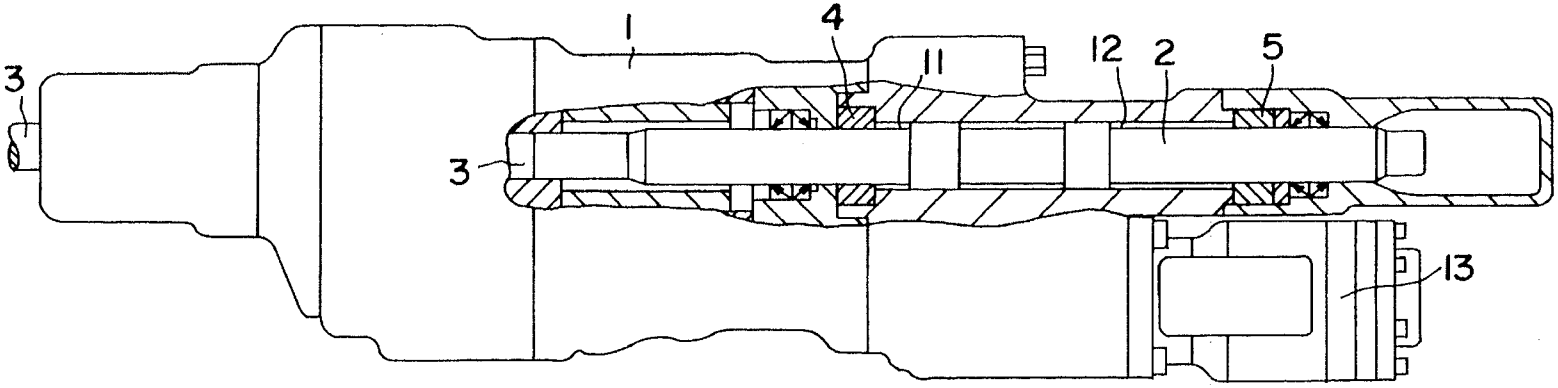

The rock drilling machine shown in the drawing comprises a machine housing 1, a hammer piston 2 moveable to-and-fro in the machine housing and intended to exert a tool 3, inserted into the machine housing, to impacts. The hammer piston is guided in guides 4,5 and provided with surfaces 11,12 which are alternately connected to a pressure source and to low pressure in order to reciprocate the hammer piston. The tool 3 is rotated by means of a motor 13 and a transmission (not shown in the drawing).

DESCRIPTION OF THE BEST MODES FOR CARRYING OUT THE INVENTION

Figure 2:
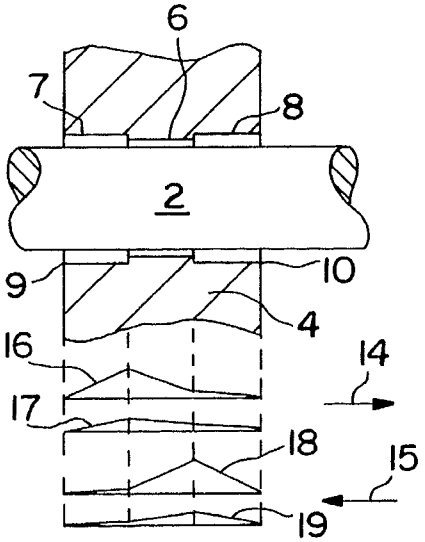
FIG. 2 shows a guide included in the invention.

In the shown example both guides 4,5 are made in the way shown in FIG. 2. In certain cases sufficient guiding can be obtained if only one of the guides are made as shown in FIG. 2. As shown in FIG. 2, guide 4 is formed with a cylindrical intermediate section 6 and on both sides thereof with cylindrical end sections 7,8. The intermediate section should have an axial extension which is less than half, preferably one third, of the length of the guide. The respective diameters of the hammer piston 2 and the intermediate section of the guide are selected so that the slot or spacing defined between the hammer piston and the intermediate section is less than three-fourths and preferably approximately one-half of the slot or spacing defined between the hammer piston 2 and the ends of the end sections of the guide which are remote from the intermediate section of the guide. In the shown example the end sections 7,8 are cylindrical for production reasons. The end sections can also be conically configured (See FIG. 2*a* of the drawing) or formed in a different configuration (as for example, multiple stepped—See FIG. 2*b* of the drawing).

Figure 3:
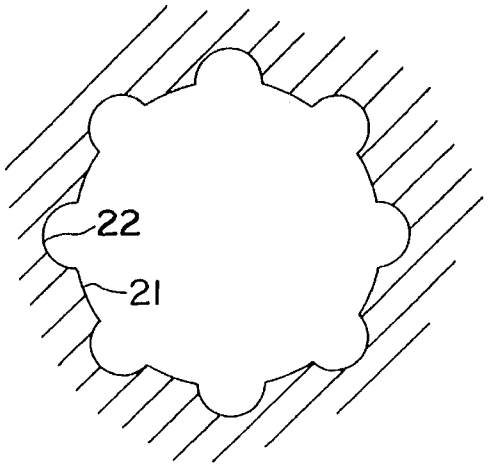
FIG. 3 shows a section of an alternative guide.

In FIG. 3 a transverse section through an alternative embodiment of the intermediate section of the guide is shown. In this case the guide has been produced by rolling so that the intermediate section comprises a number of ridges 21 and intervening grooves 22. In this case the centering pressure is built up between the ridges and the hammer piston, which is not shown in FIG. 3.

When the hammer piston moves in the direction shown by arrow 14 liquid is drawn into the slot or spaced defined between guide and hammer piston so that the axial pressure distribution on the side of the hammer piston where the slot is narrowest gets the form indicated by curve 16 and on the other side the form indicated by curve 17. When the hammer piston 2 moves in the direction shown by arrow 15 pressure distributions indicated by curves 18 and 19 are obtained. These pressure distributions apply a side force to the hammer piston which strives to center the hammer piston in the guide. In the shown example the pressure distributions are given in the most critical situation when neither side of the guide is pressurized. The guide functions in the same way if either side of the guide is pressurized. However, the pressure distribution will look differently.

I claim:

1. Liquid driven hammer machine comprising a machine housing (1), a hammer piston (2) movable to-and-fro in the machine housing for exerting impacts against a tool (3) inserted into the machine housing, and two guides (4,5) arranged at a distance from each other in the machine housing for guiding the movement of the hammer piston, characterized in that at least one of said guides (4,5) comprises an intermediate section (6) and two end sections (7,8), said hammer piston and said at least one guide being configured and relatively arranged such that a space defined between said hammer piston and said intermediate section of said guide is less than a space defined between said hammer piston and either of said end sections of said guide, said at least one guide having a predetermined length, and said intermediate section (6) extending a distance in an axial direction which is less than half the length of the guide (4).

2. Liquid driven hammer machine according to claim 1, characterized in that said intermediate section (6) extends a distance in said axial direction which is approximately one third of the length of the guide (4).

3. Liquid driven hammer machine according to claim 1, characterized in that said space defined between said intermediate section (6) and the hammer piston (2) is less than three fourths the space defined between the end sections (7, 8) at remote ends (9,10) thereof and the hammer piston (2).

4. Liquid driven hammer machine according to claim 3, characterized in that the space defined between said intermediate section (6) and the hammer piston (2) is approximately one half of the space defined between the end sections (7,8) at said remote ends (9,10) thereof and the hammer piston (2).

5. Liquid driven hammer machine according to claim 1 characterized in that said intermediate section (6) and said end sections are cylindrical sections.

6. Liquid driven hammer machine comprising a machine housing (1), a hammer piston (2) movable to-and-fro in the machine housing for exerting impacts against a tool (3) inserted into the machine housing, and two guides (4, 5) arranged at a distance from each other in the machine housing for guiding the movement of the hammer piston, characterized in that at least one of said guides (4, 5) comprises an intermediate section (6) and two end sections (7, 8), said hammer piston and said at least one guide being configured and relatively arranged such that a space defined between said hammer piston and said intermediate section of said guide is less than a space defined between said hammer piston and either of said end sections of said guide, said end sections (7, 8) being conical sections.

7. Liquid driven hammer machine comprising a machine housing (1), a hammer piston (2) movable in said machine housing for impacting against a tool (3) inserted into the machine housing, and two guides (4, 5) arranged at a distance from each other in the machine housing for guiding the movement of the hammer piston, characterized in that at least one of said guides (4,5) comprises an intermediate section (6) and two end sections (7,8), said hammer piston and said at least one guide being configured and relatively arranged such that a space defined between said hammer piston and said intermediate section of said guide is less than a space defined between said hammer piston and either of said end sections of said guide, said guide cooperating with liquid medium in said machine housing for applying a force to said piston for centering said piston in said machine housing, said applied force resulting from liquid pressure applied to said piston from said liquid medium in said space defined between said piston and said intermediate section of said guide, said force applied to said piston varying in response to changes in the relative position of said piston and said intermediate section of said guide resulting from variations in distribution of said liquid pressure applied to said piston, said at least one guide having a predetermined length, and said intermediate section (6) extending a distance in an axial direction which is less than half the length of the guide (4).

8. Liquid driven hammer machine according to claim 7, characterized in that said intermediate section (6) extends a distance in said axial direction which is approximately one third of the length of the guide (4).

9. Liquid driven hammer machine according to claim 7, characterized in that said space defined between said intermediate section (6) and the hammer piston (2) is less than three fourths the space defined between the end sections (7, 8) at remote ends (9,10) thereof and the hammer piston (2).

10. Liquid driven hammer machine according to claim 9, characterized in that the space defined between said intermediate section (6) and the hammer piston (2) is approximately one half of the space defined between the end sections (7,8) at said remote ends (9,10) thereof and the hammer piston (2).

11. Liquid driven hammer machine according to claim 7, characterized in that said intermediate section (6) and said end sections are cylindrical sections.

12. Liquid driven hammer machine comprising a machine housing (1), a hammer piston (2) movable in said machine housing for impacting .against a tool (3) inserted into the machine housing, and two guides (4, 5) arranged at a distance from each other in the machine housing for guiding the movement of the hammer piston, characterized in that at least one of said guides (4,5) comprises an intermediate section (6) and two end sections (7,8), said hammer piston and said at least one guide being configured and relatively arranged such that a space defined between said hammer piston and said intermediate section of said guide is less than a space defined between said hammer piston and either of said end sections of said guide, said guide cooperating with liquid medium in said machine housing for applying a force to said piston for centering said piston in said machine housing, said applied force resulting from liquid pressure applied to said piston from said liquid medium in said space defined between said piston and said intermediate section of said guide, said force applied to said piston varying in response to changes in the relative position of said piston and said intermediate section of said guide resulting from variations in distribution of said liquid pressure applied to said piston, said end sections (7, 8) being conical sections.

* * * * *

UNITED STATES PATENT AND TRADEMARK OFFICE

CERTIFICATE OF CORRECTION

PATENT NO. : 5,458,205
DATED : October 17, 1995
INVENTOR(S) : Gunnar Wijk

It is certified that error appears in the above-indentified patent and that said Letters Patent is hereby corrected as shown below:

Col. 1. line 63: Delete "BRIEF DESCRIPTION OF THE DRAWINGS".

Col. 2, between lines 3-4: Add --BRIEF DESCRIPTION OF THE DRAWINGS --.

Figure 2A:
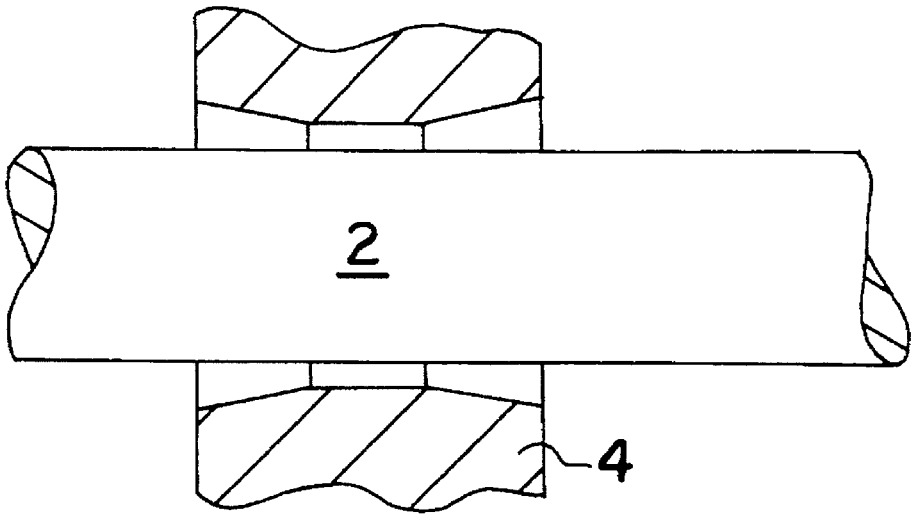
FIGS. 2*a* and 2*b* illustrate alternative configurations for guides in accordance with the present invention is described below with reference to the accompanying drawing in which fig i shows a rock drilling machine partly in section.
Figure 2B:
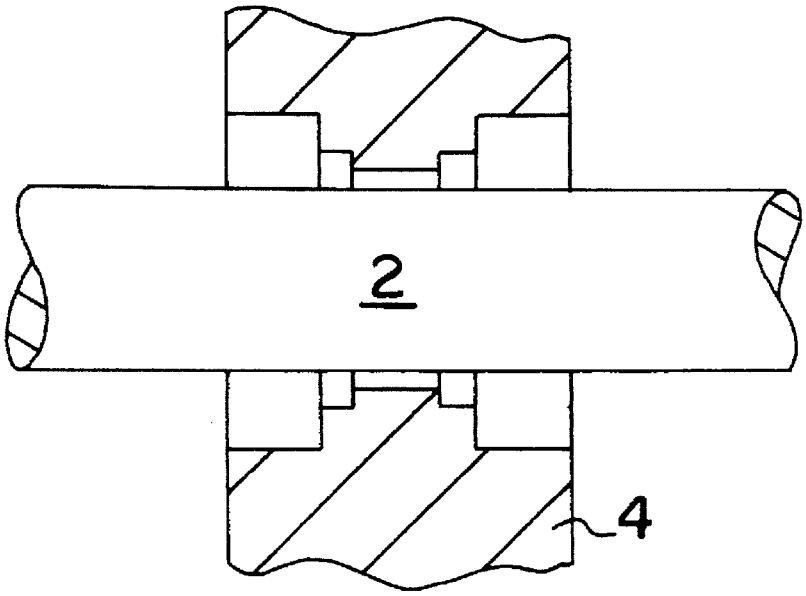

Col. 2, lines 4-5: Delete "and FIGS. 2a and 2b illustrate alternative configurations for guides in accordance with the present invention --.

Col. 2, Lines 9: After "invention", Add -- and Figs. 2a and 2b illustrate alternative configurations for guides in accordance with the present invention --.

Col. 2, between Lines 10-11: Add -- DESCRIPTION OF THE BEST MODES FOR CARRYING OUT THE INVENTION --.

Col. 2, Lines 21-22: Delete "DESCRIPTION OF THE BEST MODES FOR CARRYING OUT THE INVENTION".

Col. 2, Line 24: After "example", Add --, --.

Col. 2, Line 38: After "example", Add --, --.

Col. 2, Line 61: After "example", Add --, --.

Signed and Sealed this

Thirteenth Day of February, 1996

*Attest:*

Bruce Lehman

BRUCE LEHMAN

*Attesting Officer*

*Commissioner of Patents and Trademarks*